United States Patent [19]

Millard

[11] 3,951,656

[45] Apr. 20, 1976

[54] DIRECT-POSITIVE SILVER HALIDE EMULSION FOGGED WITH A CYANOBOROHYDRIDE ANION

[75] Inventor: Frederick William Millard, Montrose, Pa.

[73] Assignee: GAF Corporation, New York, N.Y.

[22] Filed: July 5, 1974

[21] Appl. No.: 486,196

[52] U.S. Cl. ..... 96/107; 96/108

[51] Int. Cl.[2] ..... G03C 1/28

[58] Field of Search ..... 96/107, 108

[56] References Cited

UNITED STATES PATENTS

| | | | |
|---|---|---|---|
| 3,361,564 | 1/1968 | Bigelow et al. | 96/107 |
| 3,607,288 | 9/1971 | Burt | 96/108 |
| 3,637,392 | 1/1972 | Bigelow | 96/108 |
| 3,752,674 | 8/1973 | Pritchett | 96/108 |

*Primary Examiner*—Won H. Louie, Jr.

*Attorney, Agent, or Firm*—Walter C. Kehm; James N. Blauvelt

[57] ABSTRACT

A method for chemically fogging a silver halide photographic emulsion comprising reacting cyanoborohydride anion with the silver halide thereby forming metallic silver. The cyanoborohydride is preferably in the form of an alkali metal salt. Additionally, the emulsion may optionally include a gold salt.

11 Claims, No Drawings

DIRECT-POSITIVE SILVER HALIDE EMULSION FOGGED WITH A CYANOBOROHYDRIDE ANION

BACKGROUND OF THE INVENTION

1. Field of the Invention

This invention relates to silver halide photographic emulsions that produce positive images and to photographic elements coated with such emulsions. More particularly, this invention relates to prefogged silver halide emulsions that produce positive images and to methods for the production thereof. In addition, this invention is concerned with new fogging agents for prefogging and/or refogging silver halide emulsions and to processes for producing direct positive images utilizing the emulsions produced therewith.

2. Description of the Prior Art

Silver halide photographic emulsions that produce positive images of the original upon exposure and development have long been known and have a wide application in the graphic arts. Such positive working silver halide systems can be produced in a variety of ways, most of which involve prefogging the emulsion followed by a solarizing imagewise exposure and normal black-and-white processing. The prefogging can be accomplished either by a uniform exposure to light or, more commonly, by chemical means. Chemical fogging of the silver halide grains has been accomplished in the past, for example, by the use of formaldehyde, hydrazine, sodium arsenite, silver ions, stannous salts, formamidine sulfinic acid, and other non-sulfide fogging agents. Upon imagewise exposure and development of such chemically fogged elements, a positive image is obtained.

Prior fogging agents have suffered from certain disadvantages. Recently, U.S. Pat. No. 3,361,564 has disclosed that amine boranes are suitable chemical fogging agents for direct positive silver halide emulsions which avoid the drawbacks of previously known agents. However, the use of amine boranes requires the fogging reaction to be carried out at an alkaline pH. Typically the amine borane compounds are added just prior to or during the digestion or afterripening period, and the pH adjusted to 8.0–8.5. Thereafter, the pH is lowered to the normal coating range of 5–7 prior to the addition of conventional coating aids, such as surfactants, hardeners, stabilizers, etc. The emulsion is then coated and dried in accordance with conventional photographic manufacturing methodology.

It would be desirable to carry out the prefogging reaction at the desired coating pH (5–7) and thereby avoid the two pH adjustments now occasioned by the use of amine boranes. Furthermore, it would be desirable to obviate the necessity of digesting the gelatin-containing emulsion for extended periods at elevated temperatures and high pH, since these conditions tend to degrade the gelatin through hydrolysis and can lead to undesirable changes in physical properties.

SUMMARY OF THE INVENTION

In accordance with this invention, the disadvantages inherent in prior art chemical fogging methods and compositions are overcome by the use of a cyanoborohydride anion as the chemical foggant. This anion is most conveniently derived from a metallic salt of cyanoborohydride such as alkali metal salts, e.g., sodium, potassium, or lithium. The sodium salt is especially preferred because of its commercial availability and stability.

Cyanoborohydride anion has been found to be effective under the acid conditions encountered in the coating methodology involved in the preparation of photographic elements coated with a silver halide photographic emulsion. This fact enables the chemical foggant of this invention to be incorporated into the photographic emulsion without the undesirable adjustment to the alkaline pH conditions required for effective use of the amine boranes disclosed in U.S. Pat. No. 3,361,564. This results, not only in a procedural simplification, but also avoids the long periods of digestion at elevated temperatures and high pH, and entirely obviates the disadvantages of the prior art amine boranes.

Furthermore, the inherent disadvantages of the other prior art chemical foggants of this invention produce silver halide photographic emulsions exhibiting excellent reversal density, exposure times, and contrast. Furthermore, the direct positive photographic elements incorporating the novel foggants of this invention do not require multiple exposure or developing steps and the resulting direct positive images produce clean whites and good sensitometric characteristics.

Although the cyanoborohydride anion of this invention can be employed as a chemical prefoggant in the preparation of prefogged silver halide photographic emulsions, in another embodiment of this invention, the cyanoborohydride anion can be employed as a refogging agent to decrease the speed, increase D-Max. and increase sensitometric control of an underfogged emulsion prior to final coating.

The emulsions used in the manufacture of direct positive photographic elements, such as contact duplicating film, are generally chemically prefogged. The level of fogging is controlled by the amount of fogging agent used and determines the photographic speed, rate of development and maximum density. Unfortunately, the fog centers (latent image) are unstable in cold room storage conditions resulting in regression with attendant gain in speed and loss in development rate and maximum density. With short term storage, the regression is so slight that the emulsion can be considered stable. Beyond this, latent image regression may become severe enough to necessitate refogging the emulsion in order to maintain the product within speed, maximum density and silver deposition specifications.

Partial refogging can be conveniently accomplished in accordance with the present invention by the addition of very small amounts of cyanoborohydride anion as a coating final. The optimum quantity of cyanoborohydride anion for adjustment of a particular emulsion is best determined empirically in small scale experiments using the guidelines described hereinafter.

DETAILED DESCRIPTION OF THE INVENTION

The prefogged silver halide photographic emulsions of this invention can be prepared by reaction of the cyanoborohydride anion with the photographic emulsion, generally just prior to or during the ripening thereof.

The fogging agents of the present invention can be used in any direct positive emulsion. The exact emulsion formulation is not considered critical. Illustrative direct positive emulsions are those described in U.S. Pat. Nos. 3,733,198, 3,733,199, and 3,738,846, the pertinent portions of which are incorporated herein by reference.

Generally, the fogging reaction is effected by digesting the silver halide emulsion at the normal coating pH, i.e., in the range of about 5–7, in admixture with the cyanoborohydride anion for a period of time ranging from about 15 to about 60 minutes at a temperature of about 45° to 65° C. It is convenient, although not considered important, to handle the cyanoborohydride anion as a dilute (1/1000) aqueous solution of commercially available sodium cyanoborohydride (a stable white solid that forms aqueous solutions that are stable to a pH of 2–3). Such solutions are stable over a period of several days. After digestion, the temperature is lowered to from about 28° to about 40° C. and any desired additives such as surfactants, hardeners, stabilizers and the like can then be added as the final preliminary to coating.

Reversal speed and contrast as well as development rate and D-Max. (Maximum Density) and D-Min. (Minimum Density) are determined in part by the amount of foggant employed. In general, the best results are obtained when the ratio of cyanoborohydride anion to silver halide is adjusted so that satisfactory D-Max. and development rate are obtained. This ratio can be readily determined by simple experimentation. Use of amounts larger than such optimum ratio tend to increase D-Min. and gradient and reduce speed without providing useful increases in D-Max. and development rates. For purposes of illustration, the optimum amount of sodium cyanoborohydride has been found to be 18 mg/mole AgX (1.8 meq/mole AgX) for a conventional silver bromoiodide emulsion. The optimum ratio will vary as the particular cyanoborohydride metal salt, crystal size, halide composition and other emulsion parameters are altered; nevertheless, the optimum ratio generally ranges from about 0.1–200 mg. sodium cyanoborohydride per mole AgX (0.01–20 meq cyanoborohydride anion per mole AgX), and preferably ranges from about 0.1 to 30 mg. sodium cyanoborohydride per mole AgX (0.01 to 0.30 meq. cyanoborohydride anion per mole AgX).

The following reaction equation sets forth the stoichiometry believed to be encountered in the reaction of the cyanoborohydride anion in creating the fogging effect with respect to the silver halide photographic emulsions of this invention:

$$BH_3CN^{\ominus} + 6Ag^{\oplus} + 3H_2O \rightarrow B(OH)_3 + 6Ag^{\circ} + HCN + 5H^{\oplus}$$

In all cases, the amount of foggant employed should be sufficient to fog the emulsion, yet limit the amounts of HCN formed to safe levels, e.g., no more than $3\times10^{-3}$ moles HCN. While one molecule of HCN is liberated for every six atoms of silver formed, the practical concentrations involved in fogging silver halide emulsions limits the amounts of HCN formed to insignificant levels from the standpoint of forming hazardous concentrations of the toxic gas.

Although the chemical foggants of this invention can most conveniently be added prior to or during the ripening or digestion of the emulsion, it should be understood that the chemical foggant can be added to the emulsion at any time after the initial formation of the constituents of the photographic emulsion. The cyanoborohydride anion is effective under the acid conditions encountered during emulsion formation.

Along with the chemical foggants of this invention, there may also be added a small amount of a gold compound in order to produce an emulsion having improved speed and stability. The gold compound may, like the cyanoborohydride compound, be added to the emulsion prior to or during the ripening of the emulsion or during the digestion thereof. Conveniently, the gold and cyanoborohydride compounds are added simultaneously. The gold compound may contain gold in either the $Au^{+}$ or $Au^{+++}$ valence state and should be present in an amount ranging from about 1 to about 10 millimoles of gold per mole of AgX. Suitable gold compounds include water-soluble gold salts such as auric chloride, aurous thiocyanate, sodium chloroaurate, potassium aurate, potassium chloroaurate, potassium bromaurite, potassium iodoaurite, potassium iodoaurate, potassium auricyanide and potassium aurithiocyanate. Potassium chloroaurate is a preferred salt for this purpose and is used in amounts of from about 0.10 to 2.5 mg. per mole of AgX.

The level of fogging can deteriorate or regress with time under cold storage conditions. Thus, under-fogged emulsions or pre-fogged emulsions which have undergone regression in cold room storage can be refogged by treatment with cyanoborohydride anion in accordance with the present invention.

Partial refogging can be conveniently accomplished by the addition of very small amounts of cyanoborohydride anion as a coating final. The optimum quantity of cyanoborohydride anion for refogging of any given emulsion can be easily determined by simple experimentation. Typically, a 1:4000 aqueous solution of cyanoborohydride anion can be added to the emulsion as the initial final at a level of about 4.0 ml/kg emulsion. The emulsion can then be held at about 30°–50° C. for about 50 to 70 minutes before addition of the conventional coating finals. The pH of the emulsion during this period should be within the normal range of 5–7. It has been found in accordance with the present invention that a substantially linear speed decrease is effected upon refogging with use of increasing amounts of cyanoborohydride anion, generally producing about a 0.03–0.04 Log E speed decrease per ml. of 1:4000 aqueous cyanoborohydride solution per kg. emulsion.

The optimum ratio for partial refogging generally ranges from about 0.10 to 200 mg. of sodium cyanoborohydride per mole AgX (0.01–20 meq. cyanoborohydride anion per mole AgX) and preferably ranges from about 0.1 to 30 mg sodium cyanoborohydride per mole AgX (0.01 to 0.30 meq. cyanoborohydride anion per mole AgX).

The chemical foggants of this invention are most preferably employed in connection with the preparation of direct positive photographic silver halide emulsions. In effecting the fogging reaction, it is preferred to bring the emulsion to a level of fogging capable of producing the desired maximum density on development. Upon imagewise exposure and development of such a fogged element, a positive image can be obtained.

The emulsions of this invention can be coated on any suitable base including paper as well as transparent film supports. Illustrative of such transparent film supports are such polymeric supports as cellulosic type supports such as cellulose acetate, cellulose triacetate and the like, vinyl polymers and copolymers such as vinyl acetate, vinyl chloride, polystyrene, vinyl acetate/vinyl chloride copolymers and the like, polyester supports and the like. These emulsion coated elements can produce good duplicates by contact printing using either carbon arc lamps or tungsten photo flood lamps as a light source. These emulsion coated elements can be employed for reproducing continuous tone negatives, halftones, line copy, engineering drawings, and the like. Moreover, these emulsion coated elements can be used in both black-and-white and color photography.

The following examples further illustrate the present invention. Unless otherwise stated, all percentages and parts are by weight.

EXAMPLE I

A gelatino silver bromoiodide emulsion with high internal sensitivity was prepared as follows: To an alkaline aqueous solution of gelatin containing 0.37 mole of NaCl there was added via double-jet addition, over a period of 20 minutes, two equal volume solutions containing 0.38 mole NaCl and 0.38 mole of $AgNO_3$ respectively. The temperature was maintained at 60° C. throughout the precipitation and the emulsion was digested at the same temperature for 10 minutes after completion of the addition. A solution containing 0.60 mole KBr and 0.06 mole KI was then added over a period of 10 minutes and the emulsion again digested for 20 minutes at 65° C.

The resulting silver bromoiodide emulsion was then precipitated in the manner disclosed in U.S. Pat. No. 2,618,556, using ammonium sulfate, and the precipitate washed free of soluble salts and redispersed with the addition of 35 g of bulking gelatin. The pH and pAg were determined to be 6.3 and 7.9, respectively, and were not adjusted prior to fogging with sodium cyanoborohydride.

Fogging was accomplished by adding a 0.10% aqueous solution of sodium cyanoborohydride to the molten emulsion in an amount equal to 18 mg $NaCNBH_3$ per mole of silver halide. The temperature was then raised to 55° C. and held for 30 minutes with agitation. The temperature was then reduced to the normal coating temperature (28°–40° C.) and the usual emulsion additives added prior to coating on a conventional photographic film support with an anchoring polymeric substratum. The emulsion was coated at a silver deposition of 4.8 gms per square meter and a thin gelatin overcoat was applied to impart abrasion resistance. Samples of the coated film were then exposed to tungsten light through a step tablet and developed using either litho or metol-hydroquinone developer to produce an intensity scale sensitometric direct positive image. In this manner, the film was found to produce a high contrast, contact speed, direct positive image with a minimum density less than 0.02 higher than that of fixed but not developed film and a maximum density in excess of 5.0 in unexposed areas.

EXAMPLE II

The foregoing example demonstrates the use of the cyanoborohydride anion of this invention as a chemical prefoggant in photographic direct positive emulsions. This example demonstrates the use of the cyanoborohydride anion as a refogging agent.

A portion of an emulsion similar to that of Example I which had been originally chemically fogged about nine weeks prior to this example was coated on a polyester support. To another portion of emulsion a 1:4000 aqueous solution of sodium cyanoborohydride was added as the initial final at a level of 4:0 ml/kg emulsion. The emulsion was then held at 40° C. for 60 minutes before addition of the normal coating finals including wetting agents and gelatin hardeners. It was then coated on a polyester support. The pH of the emulsion during the period was at the normal coating pH of 6.3.

At the 4 ml/kg level (1.48 mg sodium cyanoborohydride per mole Ag), the speed decrease achieved was 0.12 Log E at a silver coating weight of 4.54 gms/m$^2$. Without refogging, the emulsion was found to exhibit a speed of 4.35 Log E when coated at 4.59 gms/m$^2$ and 4.47 Log E speed after adjustment, consistent with the previously estimated speed decrease of 0.03–0.04 Log E units per ml of 1/4000 aqueous $NaCNBH_3$ per kg. emulsion. Speed limits for emulsions of this type are generally considered to range from 4.42 to 4.56 Log E measured at a net density of 0.10. It has been found that a 1:4000 aqueous sodium cyanoborohydride solution effects an approximately linear speed decrease with increasing amounts of cyanoborohydride anion producing about a 0.03–0.04 Log E speed decrease per milliliter 1:4000 sodium cyanoborohydride per kilogram of emulsion.

EXAMPLE III

A gelatino silver bromoiodide emulsion containing 1 mole % iodide was formed by simultaneously adding aqueous solutions of potassium iodide and bromide and silver nitrate to a rapidly agitated aqueous solution of acidified gelatin while maintaining the temperature at 70° C. The addition rates were controlled so that the pAg was maintained at approximately 5 and such that the total time of addition was 45 minutes. The resulting emulsion was then digested for an additional 30 minutes at 75° F. The emulsion was then precipitated by adding ammonium sulfate and washed in the conventional manner to a low conductivity. The emulsion so prepared has cubic grains and a narrow grain size distribution with a mean size of 0.25$\mu$m.

The above emulsion was then chemically fogged according to the following procedure using sodium cyanoborohydride and potassium chloroaurate. The melted emulsion was held at 40° C and the pAg adjusted to 9.0 by addition of a 1% aqueous solution of potassium bromide. The pH was also adjusted to 6.5 using either dilute sulfuric acid or sodium hydroxide as required. A 1/10,000 parts by weight aqueous solution of potassium chloroaurate in the amount corresponding to 0.70 mg. of $KAuCl_4$ per mole of silver was added with agitation, and the temperature raised to 70° C. At this point, a 1/100,000 parts by weight aqueous solution of sodium cyanoborohydride was added in the amount corresponding to 0.50 mg/mole Ag and the temperature maintained at 70° C for 90 minutes before cooling to 40° C. A solution of pinakryptol yellow was then added to the emulsion in the amount corresponding to 165 mgs. of dye per mole of Ag. The usual coating aids including a gelatin hardener were then added and the emulsion then coated on a photographic support and dried in the conventional manner. The coating was controlled to yield a silver coating weight of 3.5 gms/m$^2$ and a thin gelatin overcoat was applied to impart abrasion resistance. Samples of the coated film were given an appropriate sensitometric exposure to tungsten light and processed in both conventional litho and metol-hydroquinone developers. No substantial difference in sensitometric response was obtained between the two developments. In this manner, the log exposure speed measured at 0.10 density was determined to be 2.00 meter candle seconds, the gradient 4.5, minimum density 0.03 and maximum density in excess of 5.0.

Although specific materials and conditions were set forth in the above exemplary processes for prefogging and and refogging silver halide photographic emulsions with the cyanoborohydride anion, these are merely intended as illustrations of the present invention. Other modifications of the present invention will occur to those skilled in the art upon reading of the present disclosure. These are intented to be included within the scope of this invention.

What is claimed is:

1. A method for chemically fogging a silver halide photograph emulsion comprising digesting a cyanoborohydride anion with a silver halide emulsion at a pH ranging from pH 5–7, said pH being without prior adjustment, thereby forming metallic silver, said digestion proceeding for a period of time ranging from about 15 to about 60 minutes and temperatures of from about 45° to 65° C.

2. Method as defined in claim 1 wherein the cyanoborohydride anion is derived from a alkaline metallic salt of cyanoborohydride.

3. Method as defined in claim 2 wherein the metallic salt is sodium cyanoborohydride.

4. Method as defined in claim 1 wherein from about 0.01 – 20 milliequivalents of cyanoborohydride anion are employed per mole of silver halide.

5. A method as defined in claim 1 in which the emulsion additionally contains a soluble gold compound in which compound is present about 1 to 10 millimoles of gold per mole of silver halide.

6. A method for refogging an underfogged silver halide emulsion comprising adding about 0.01 to about 20 milliequivalents of cyanoborohydride anion to said underfogged emulsion, and holding said emulsion, after said addition of said cyanoborohydride anion to said emulsion, at about 30° C. to about 50° C. for about 50–70 minutes at a pH of about 5 to 7, there having been no prior pH adjustment of said emulsion.

7. A chemically fogged, direct positive silver halide photographic emulsion comprising the reaction products of a cyanoborohydride anion and a silver halide, said emulsion having been chemically fogged by digestion with said cyanoborohydride anion at a pH of 5-7, without prior pH adjustment of said emulsion.

8. A chemically fogged emulsion as defined in claim 7 wherein said cyanoborohydride anion is derived from sodium cyanoborohydride.

9. A chemically fogged emulsion as defined in claim 7 which additionally contains a water-soluble gold salt.

10. A direct positive photographic element comprising (a) a support and (b) at least one layer containing a direct positive silver halide photographic emulsion chemically fogged with a cyanoborohydride anion as defined in claim 7.

11. A direct positive photographic element as defined in claim 10, additionally comprising a water-soluble gold compound.

* * * * *